US005622190A

United States Patent [19]

Arterbery et al.

[11] Patent Number: 5,622,190

[45] Date of Patent: *Apr. 22, 1997

[54] CONCENTRIC SMOKING FILTER HAVING CELLULOSE ACETATE TOW PERIPHERY AND CARBON-PARTICLE-LOADED WEB FILTER CORE

[75] Inventors: Cynthia W. Arterbery, Midlothian; W. Timothy Callaham; Gus D. Keritsis, both of Richmond; Donald E. Laslie, Midlothian; Kenneth A. Newman, Prince George; Roger S. Slagle; Morris F. White, Jr., both of Chesterfield, all of Va.

[73] Assignee: Philip Morris Incorporated, New York, N.Y.

[ * ] Notice: The term of this patent shall not extend beyond the expiration date of Pat. No. 5,365,951.

[21] Appl. No.: 339,530

[22] Filed: Nov. 15, 1994

Related U.S. Application Data

[63] Continuation-in-part of Ser. No. 5,650, Jan. 19, 1993, Pat. No. 5,365,951, which is a continuation-in-part of Ser. No. 796,631, Nov. 22, 1991, which is a continuation-in-part of Ser. No. 571,878, Aug. 24, 1990, abandoned.

[51] Int. Cl.[6] ..... A24D 3/02

[52] U.S. Cl. ..... 131/339; 131/342; 131/344; 131/336; 131/345

[58] Field of Search ..... 131/339, 342, 131/344, 336

[56] References Cited

U.S. PATENT DOCUMENTS

| | | | |
|---|---|---|---|
| 3,128,680 | 4/1964 | Schaaf | 93/1 |
| 5,012,829 | 5/1991 | Thesing et al. | 131/344 |
| 5,115,823 | 5/1992 | Keritsis | 131/336 |
| 5,365,951 | 11/1994 | Arterbery | 131/339 |

FOREIGN PATENT DOCUMENTS

| | | | |
|---|---|---|---|
| 474940 | 12/1990 | European Pat. Off. | A24D 3/04 |
| 1324235 | 11/1961 | France . | |

*Primary Examiner*—V. Millin
*Assistant Examiner*—Charles W. Anderson
*Attorney, Agent, or Firm*—James T. Moore; James E. Schardt; Charles E. B. Glenn

[57] ABSTRACT

A concentric smoking filter in which the peripheral filter medium is a fibrous tow, such as fibrous cellulose acetate tow, and the core filter medium is a web material, such as paper, loaded with carbon particles, is provided. The filter improves the taste, particularly, of "ultra-light" cigarettes.

56 Claims, 6 Drawing Sheets

CONCENTRIC SMOKING FILTER HAVING CELLULOSE ACETATE TOW PERIPHERY AND CARBON-PARTICLE-LOADED WEB FILTER CORE

CROSS-REFERENCE TO RELATED APPLICATIONS

This application is a continuation-in-part of commonly assigned U.S. patent application Ser. No. 08/005,650, now U.S. Pat. No. 5,365,951 filed Jan. 19, 1993, now allowed, which is a continuation-in-part of commonly assigned U.S. patent application Ser. No. 07/796,631, filed Nov. 22, 1991, which is a continuation-in-part of U.S. patent application Ser. No. 07/571,878, filed Aug. 24, 1990, now abandoned.

BACKGROUND OF THE INVENTION

This invention relates to smoking filters, and particularly to concentric smoking filters. More particularly, this invention relates to concentric smoking filters having tow and web filter media portions arranged concentrically.

Most smoking filters, particularly cigarette filters, sold commercially as part of cigarettes consist of a cylindrical rod or "plug" of a "tow" of plasticized cellulose acetate fibers. Some filters are variants of the standard filter, having recessed mouth ends, or being made of two plugs placed end-to-end with a space in between, the space being either empty or filled with another material such as charcoal. It is also known to provide such filters having multiple plugs abutting one another, the different plugs differing in density or other characteristics.

Similarly, it is known to provide filtering media other than cellulose acetate. One such medium is an appropriate sheet or web material. The web material, which is gathered into a cylindrical plug, can be paper or any other web material, including cellulose acetate in sheet form. When such web materials are used as filters, they are frequently corrugated before being gathered. Paper webs may also be creped to improve tensile strength, elongation properties and machinability.

Some of these different materials and different constructions have been combined. For example, it is known to provide filters having two or more abutting plugs, at least one of which is cellulose acetate tow, and at least one of which is a web material.

Finally, it is known to provide "concentric filters" in which two different forms of cellulose acetate tow—differing, e.g., in density—are formed into a filter. One cellulose acetate tow forms a cylindrical "core", while the other tow forms an annular peripheral layer.

Smoking filters are characterized by various parameters, including pressure drop, which is referred to as resistance-to-draw ("RTD") and usually measured as the height of a column of water, and efficiency, which is measured as the percentage of the total particulate matter ("TPM") in the unfiltered smokestream that is trapped by the filter. The RTD of a filter affects how smokers perceive the filter in terms of how hard they must draw on it to receive a desired amount of smoke, while the filter efficiency controls the amount of TPM delivered in the smoke.

It has been found that while web filters, and particularly paper filters, are more efficient than tow filters, the web material, especially paper, adds a different taste to the smoke which may alter subjective smoker satisfaction. In addition, the appearance of the visible deposited smoke components on the end of a paper filter is much less regular, and more spotty, than on a cellulose acetate tow filter, again affecting the aesthetic perception of the smoker. This difference in appearance is believed to result from the channelling of deposited material in the channels formed by the corrugation and gathering of the web during plug making.

As consumer preferences tend toward lower delivery cigarettes, the need for higher efficiency filters, which allow lower delivery without increased filter RTD, increases. However, the higher efficiency of paper filters could not previously be taken advantage of because of the negative consumer perceptions of products with paper filters.

It would be desirable to be able to provide a high efficiency filter which produced low delivery while also delivering acceptable taste, RTD, and other aesthetic impacts.

SUMMARY OF THE INVENTION

It is an object of this invention to provide a high efficiency filter which produces low delivery while also delivering acceptable taste, RTD and other aesthetic impacts.

In accordance with this invention, there is provided a smoking filter comprising a first filter plug having a central core of a gathered corrugated web material and a peripheral layer of a cellulose acetate tow filter material surrounding the central core. Each of the central core and the peripheral layer has a resistance-to-draw, the central core having a resistance-to-draw of between about 200 mm W.G. and about 500 mm W.G. and the filter having a resistance-to-draw of between about 100 mm W.G. and about 230 mm W.G. The peripheral layer has a lower resistance-to-draw than the central core, to initially direct, when the filter is attached to a smoking article and the smoking article is smoked, a greater fraction of smoke through the peripheral layer than through the central core. The central core is loaded with between about 5 mg and about 35 mg of carbon particles. The carbon particles have a size distribution such that 95% of the particles are between about 12 mesh and about 70 mesh. The carbon particles have a moisture content between about 3% and about 20.5% of their dry weight, and a carbon particle activity between about 19% and about 27% butane activity. The first filter plug further has means for admitting ventilation air through the peripheral layer toward the central core, whereby smoke initially directed into the peripheral layer flows back into the central core, whereby when the filter is attached to a smoking article and the smoking article is smoked, the filtered smoking article delivers smoke containing a particular level of total particulate matter, and the taste of the smoking article is a taste associated with smoke having a level of total particulate matter higher than that particular level.

A dual filter including the first filter plug and a conventional second filter plug is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

In accordance with the present invention, it has unexpectedly been found that when a concentric filter is made with paper or other web material in the core, and cellulose acetate tow in the periphery, or vice-versa, not only is high filtration efficiency achieved without the introduction of an undesired taste from the paper, but a cigarette with low TPM delivery can be produced which has the taste of a cigarette with a higher TPM delivery.

Figure 1:
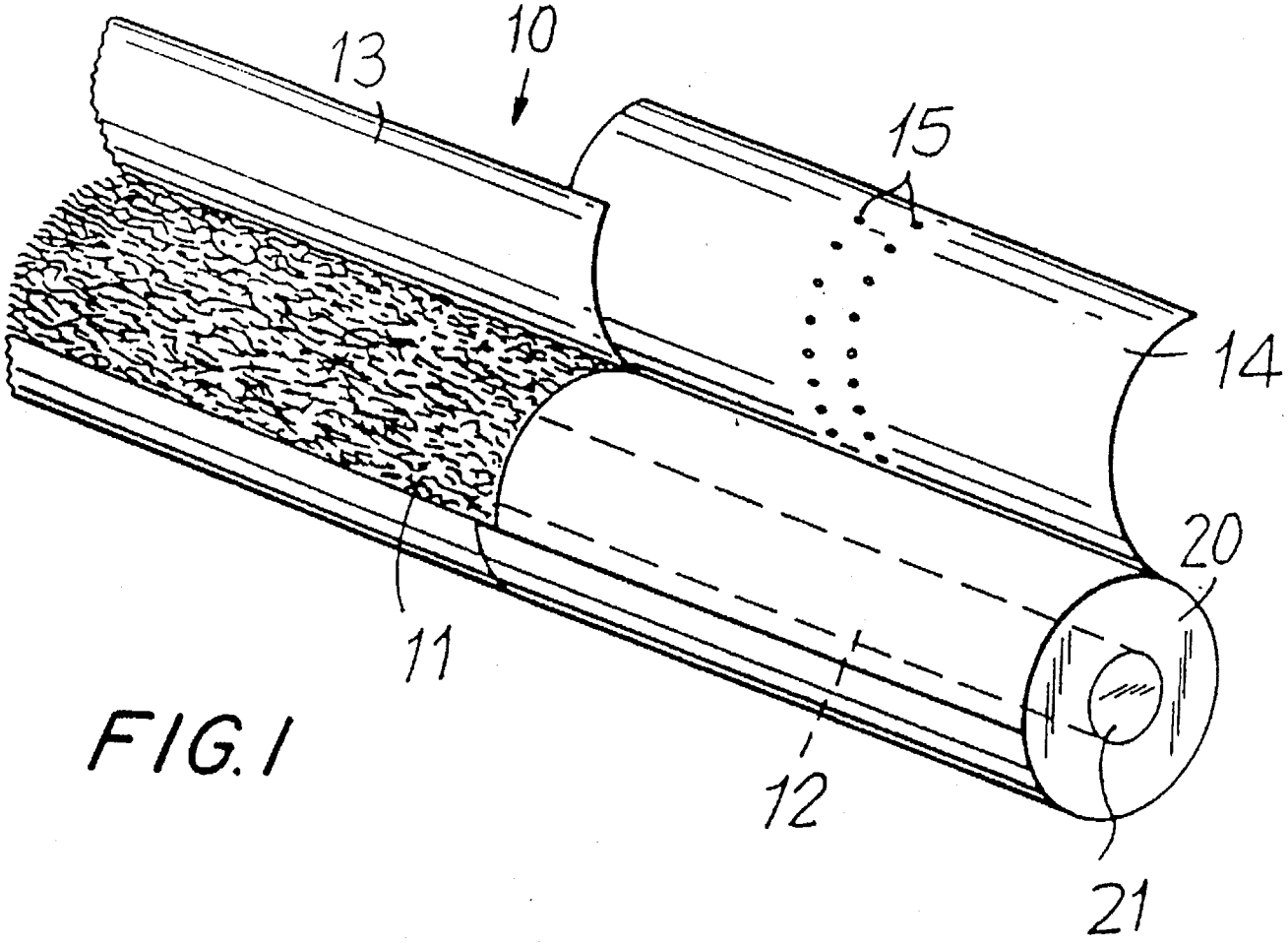
FIG. 1 is a mouth end perspective view of a cigarette having a first embodiment of a filter according to the present invention.
Figure 2:
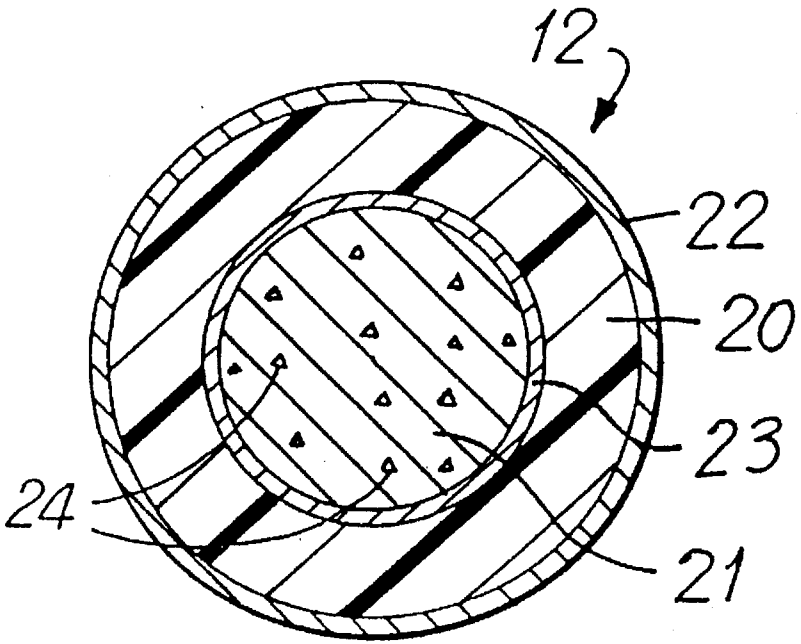
FIG. 2 is a radial cross-sectional view of the filter of FIG. 1.

As shown in FIGS. 1 and 2, cigarette 10 includes a tobacco rod 11 and a first preferred embodiment of a filter 12 according to this invention. Tobacco rod 11 is wrapped in conventional wrapper 13, while filter 12 is wrapped by conventional tipping 14. Filter 12 includes peripheral layer 20 and central paper core 21. Peripheral layer 20 is any appropriate fibrous or filamentary tow filter material such as a conventional cellulose acetate tow, preferably wrapped by porous plug wrap 22, although self-supporting filter rod technology, such as steam bonding or spray coating of the outer surface of peripheral layer 20, can be used to make a filter that need not be wrapped, if desired. Paper core 21 is a paper web that has been corrugated and gathered into cylindrical form and wrapped with plug wrap paper 23.

Plug wrap 23 improves the processibility of core 21 as well as its aesthetic appearance, and also helps to assure substantially perfect concentricity. Flavorants or other additives, such as soluble tobacco components, could be applied to plug wrap 23 to enhance the subjective taste aspects of the filtered smoke. A similar result might be achieved by forming plug wrap 23 from a tobacco-containing material, such as reconstituted tobacco sheet. Plug wrap 23 is preferably porous, to allow smoke and air to freely move radially between peripheral layer 20 and core 21 but may be non-porous. At the same time, the presence of plug wrap 23 helps prevent channelling of smoke along the interface between peripheral layer 20 and core 21.

The most preferred embodiment of filter 12 has a circumference of about 24.45 mm and an average weight of about 258 mg. The cross-sectional area of core 21 occupies between about 20% and 80% of the total cross-sectional area of filter 12, and preferably makes up about 60% of the total cross-sectional area of filter 12. Paper core 21 thus preferably has a circumference between about 18.10 mm and about 18.80 mm and preferably about 18.45 mm. Filter 12 preferably has an RTD of between 100 mg W.G. and about 230 mm W.G., and more specifically between about 100 mm W.G. and about 150 mm W.G., with the RTD of central core 21 being between about 200 mm W.G. and about 500 mm W.G., more particularly between about 285 mm W. G. and about 500 mm W. G. and more specifically about 200 m W.G. and about 400 mm W.G. More preferably, filter 12 has an RTD of about 146 mm W.G., with the RTD of central core 21 being about 400 mm W.G.

In the particularly preferred embodiment, the cellulose acetate tow of peripheral layer 20 is a cellulose acetate tow having a denier per filament between approximately 2.0 to 12.0 and a total denier between approximately 20,000 to 60,000, and a "Y" cross-sectional shape. The web of core 21 is preferably a 100% cellulose semi-creped softwood pulp paper with about 3–20% , and preferably about 10%, crosswise creping for added tensile strength and elongation properties. Such a paper is available from Tela Papierfabrik AG, of Balsthal, Switzerland. The peripheral layer 20 alternatively has an "R", "X" and "O" or "I" cross-sectional shape. Alternatively, other filamentary tow materials are employed, such as polyolefins, and more particularly polypropylene or polyethylene. Crimping can modify filter performance such as filtration efficiency and/or firmness. In addition, the selected tow material can be slit, blown with air, brushed, wetted, etc. per conventional techniques to modify filter performance.

Cigarette 10 is preferably ventilated to between about 50% and about 75% ventilation, more preferably between about 40% and about 70% ventilation to result in filtration efficiency between about 60% and 90%, and more preferably about 67% ventilation, to result in filtration efficiency of about 76%, with appropriate ventilation holes 15 provided in tipping 14. If the surface of filter 12 is not air permeable, appropriate holes would also be provided in filter 12.

Figure 3:
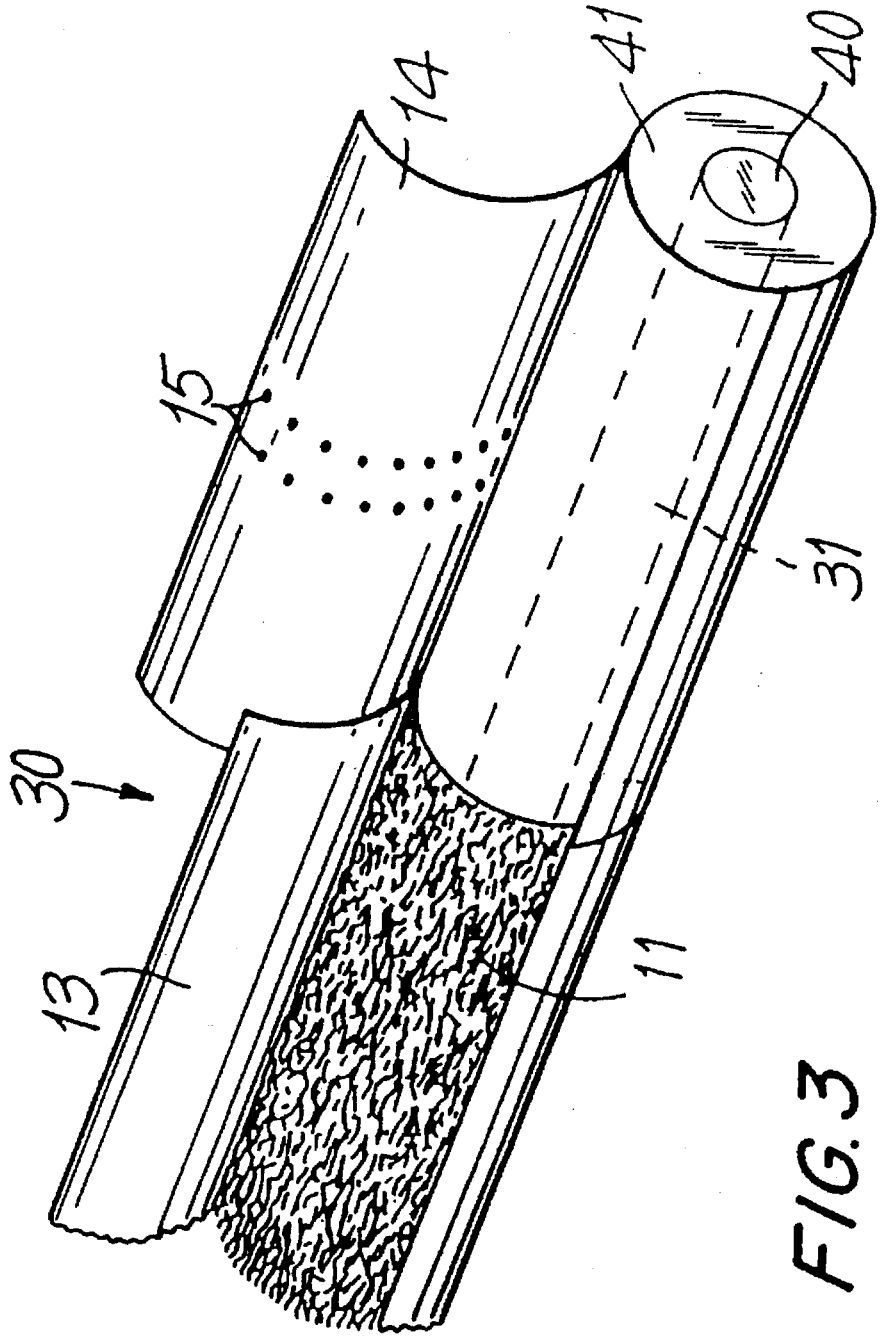
FIG. 3 is a mouth end perspective view of a cigarette having a second embodiment of a filter according to the present invention.
Figure 4:
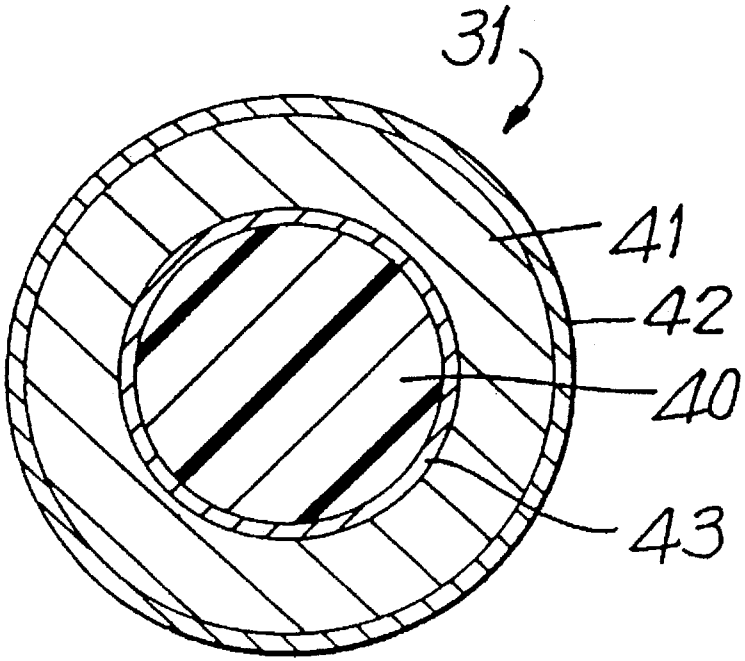
FIG. 4 is a radial cross-sectional view of the filter of FIG. 3.

FIGS. 3 and 4 show a cigarette 30 having a second preferred embodiment of filter 31 similar in construction to filter 12, except that core 40 is a tow material and peripheral layer 41 is a web material. Similarly, in this embodiment plug wrap 42 is necessary to contain the web material of peripheral layer 41, while plug wrap or other permeable wrap 43 around tow core 40 is optional, as tow core 40 could be made using self-supporting filter rod technology, as above.

The most preferred embodiment of filter 31 has a circumference of about 24.45 mm and an average weight of about 240 mg. The cross-sectional area of core 40 preferably makes up about 60% of the total cross-sectional area of filter 31. Filter 31 preferably has an RTD of between about 165 mm W. G. and about 195 mm W. G., with the RTD central core being about 285 mm W.G. and about 385 mm W.G. More preferably, filter 31 has an RTD of about 182 mm W.G., with the RTD of central core 40 being about 334 mm W.G..

In this embodiment, the cellulose acetate tow of core 40 is preferably a 1.6/35000 cellulose acetate tow having a denier per fiber of 1.6, a total denier of 35,000, and a "Y" cross-sectional shape. The web of peripheral layer 41 is preferably the same 100% cellulose semi-creped softwood pulp paper, with 10% crosswise creping for added tensile strength, that is used in core 21 of filter 12.

Cigarette 30 is preferably ventilated to between about 50% and about 75% ventilation, and more preferably about 67% ventilation, with appropriate ventilation holes 15 provided in tipping 14, as in cigarette 10.

Figure 5:
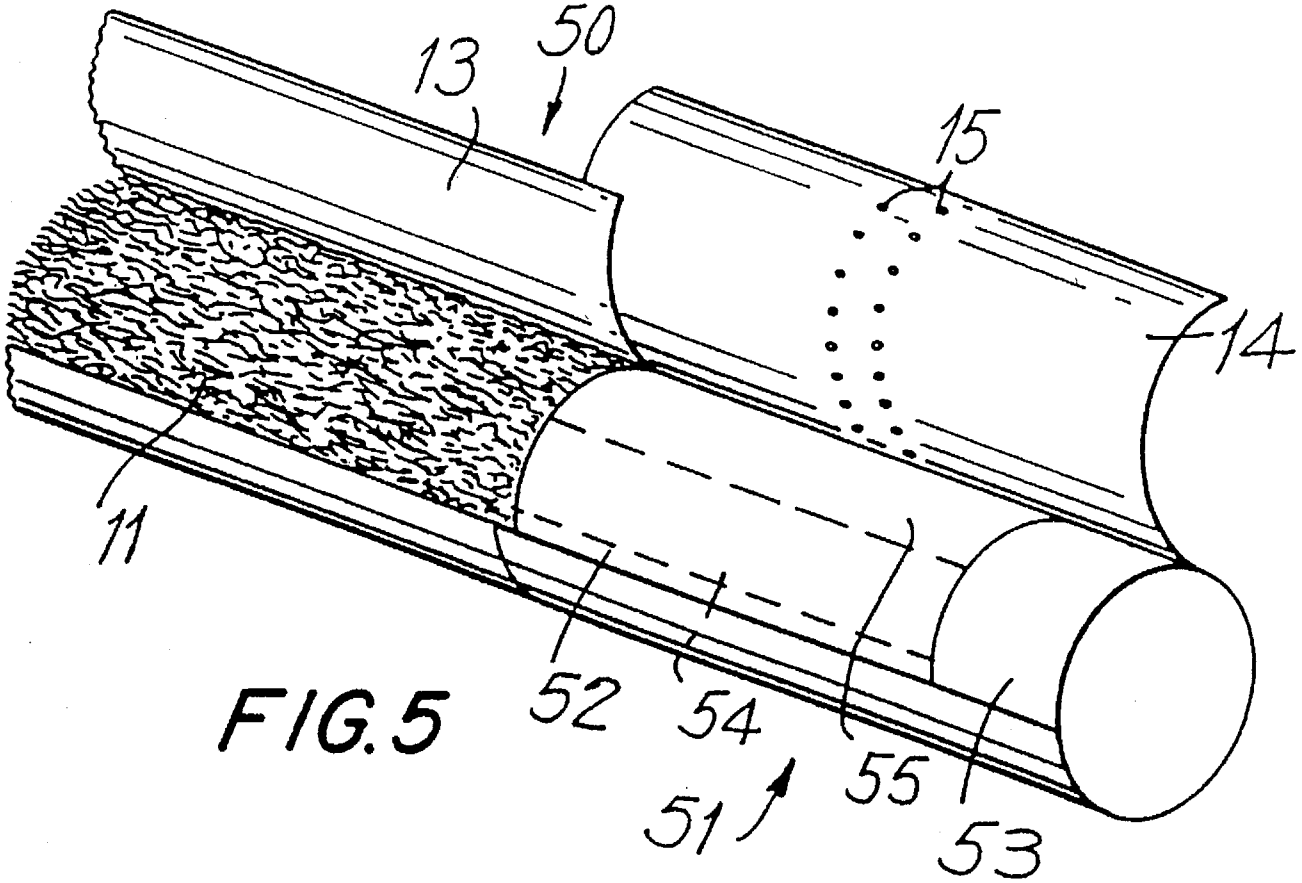
FIG. 5 is a mouth end perspective view of a cigarette having a third embodiment of a filter according to the present invention.

FIG. 5 shows a cigarette 50 having a third preferred embodiment of a filter 51 according to the invention. Filter 51 is a so-called "dual" filter, made up of two abutting filter segments 52,53. Filter segment 52, which is adjacent tobacco rod 11, is a concentric filter as discussed above, in which one of core 54 and peripheral layer 55 is of a web material and the other of core 54 and peripheral layer 55 is of a tow material. Filter segment 53, which is at the mouth end, is a conventional tow filter, such as a cellulose acetate filter, and is provided primarily for cosmetic purposes. Nevertheless, segment 53 has filtration and RTD characteristics, and segment 52 must be adjusted so that the overall filter 51 has the desired characteristics.

In a preferred form of this embodiment, segment 52 is constructed like filter 12, but has a length of only 18–20 mm, while segment 53 is a 7–9 mm long plug of 8.0/40000 cellulose acetate for tow having a denier per fiber of 8.0, a total denier of 40,000, and a "Y" cross-sectional shape, although the other cross-sectional shapes discussed with reference to FIGS. 1 and 2 can be employed. Total filter RTD is between about 100 mm W.G. and about 180 mm W.G., preferably about 160 mm W.G. The RTD of segment 53 is between about 10 mm W. G. and about 45 mm W.G., preferably about 18 mm W.G. The RTD of segment 52 is between about 85 mm W.G. and about 175 mm W.G., preferably about 140 mm W.G. The RTD of the paper core 54 of segment 52 is between about 195 mm W.G. and about 450 mm W.G., preferably about 267 mm W.G. Cigarette 50 made with this embodiment of filter 51 is ventilated to between about 50% and about 75% ventilation, preferably about 71% ventilation, with appropriate ventilation holes 15 in tipping 14.

Figure 6:
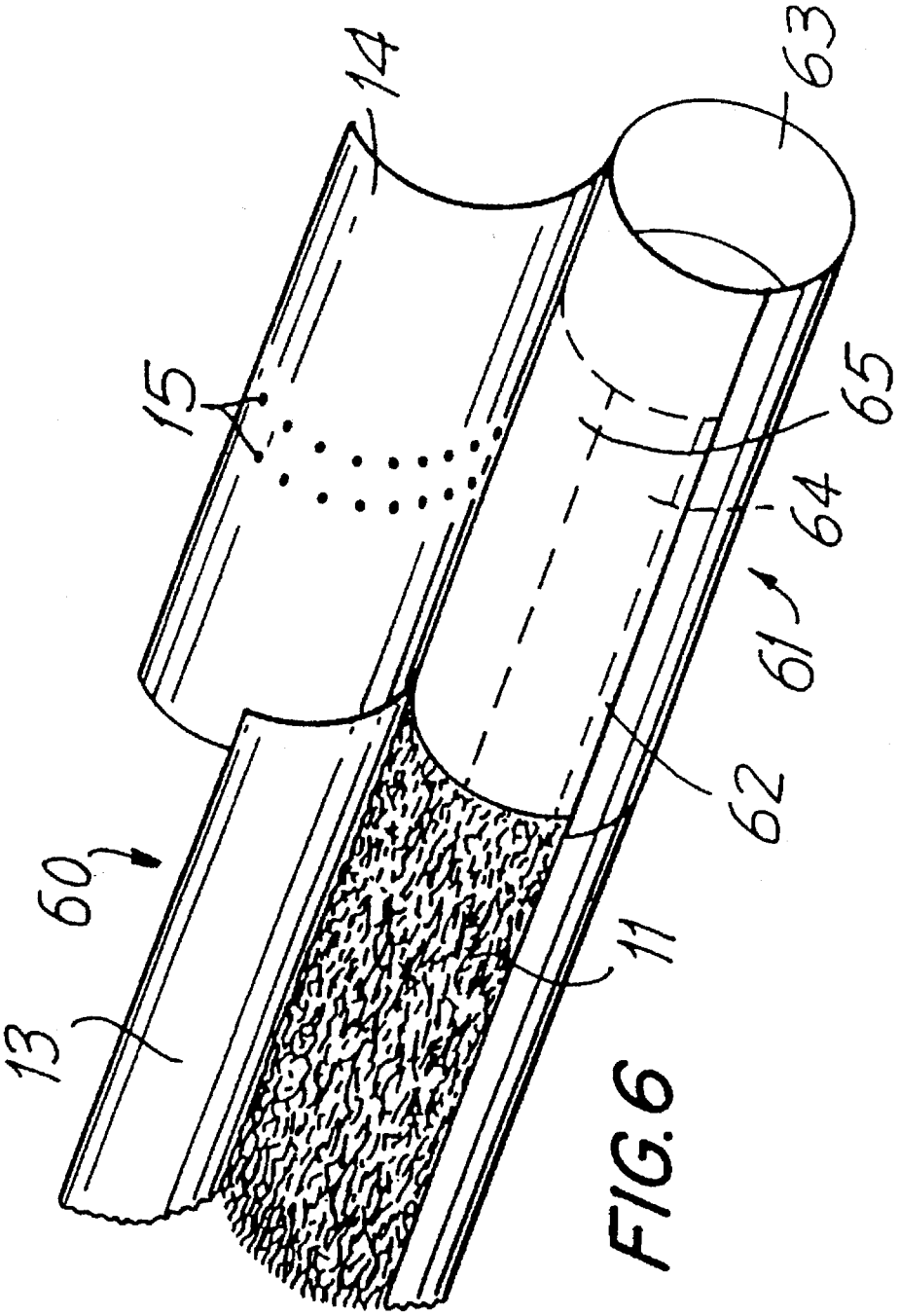
FIG. 6 is a mouth end perspective view of a cigarette having a fourth embodiment of a filter according to the present invention.

FIG. 6 shows a cigarette 60 having a fourth embodiment of a filter 61 according to the invention. Filter 61 is a recessed filter, made up of filter segment 62 recessed into tipping 14 at 63. Filter segment 62, which is adjacent tobacco rod 11, is a concentric filter as discussed above, in which one of core 64 and peripheral layer 65 is of a web material and the other of core 64 and peripheral layer 65 is of a tow material.

A fifth, particularly preferred embodiment of the present invention is similar to that of FIGS. 1 and 2, having a central paper core 21 and a fibrous or filamenary tow such as cellulose acetate peripheral layer 20, with the design parameters discussed above, except that core 21 is loaded with interspersed carbon particles or dust 24 which are preferably uniformly distributed throughout core 21. Dust is defined as greater than 325 mesh, i.e. , dust particles will pass through a 325 mesh screen. One way of distributing the particles is to drop them from a vibratory conveyor onto the corrugated web before it is gathered and wrapped to form core 21. Preferably, the particles, once distributed onto the web, are kept in place by a liquid tack solution, such as a dilute solution of hydroxypropylcellulose e.g., 7.5% by weight in water, which may be that sold by Aqualon Company of Hopewell, Va., under the Trademark KLUCEL®. The amount of the solution that is added is preferably about 1% by weight of the dry web. In another embodiment, the carbon is manufactured into the paper, e.g., interspersed or impregnated, during the paper making process.

Each filter plug 12 modified according to this fifth embodiment has between about 5 mg and about 35 mg, preferably about 10 mg, of carbon particles. Generally, it is prefer, red to have between approximately 0.5 mg to approximately 3.0 mg of carbon per mm of filter length. Conventional filter lengths would accordingly possess between approximately 10 to approximately 60 mg of carbon, and preferably about 60 mg. of carbon. The carbon particles have a size distribution such that about 95% of the particles are between 12 mesh and about 70 mesh.

More particularly, the carbon particles are, e.g., coconut base having a particle size between approximately 12–30 mesh or approximately 20–70 mesh, or coal base having a particle size between approximately 14–40 mesh. The carbon particles have a moisture content between about 3% to about 20.5% and more particularly between about 15.5% and about 20.5%,and preferably about 18%, of their dry weight, and a butane activity range between approximately 19–27%.

Filters according to this fifth embodiment exhibit about 85% reduction of gas phase in the filtered smoke. A reduction of about 17% is attributable to the carbon particles, with the remainder of the reduction attributable to the filter independent of the carbon particles.

A filter plug according to this fifth embodiment can also be used in the embodiment of FIG. 5, in place of plug 52. In such a filter, total filter RTD is between about 100 mm W.G. and about 180 mm W.G., preferably about 160 mm W.G. The RTD of segment 53 is between about 10 mm W.G. and about 45 mm W.G., preferably about 14 mm W.G., and more preferably about 13.2 mm W.G. The RTD of the filter plug according to this fifth embodiment is between about 85 mm W.G. and about 175 mm W.G., preferably about 146 mm W.G. The RTD of the inner paper core of the segment according to this fifth embodiment is between about 195 mm W.G. and about 145 mm W.G., more preferably between about 268 mm W.G. and about 446 mm W.G., preferably about 357 mm W.G. The filter is preferably ventilated to about 67% ventilation.

The filter parameters discussed herein are valid for 85 mm and 100 mm cigarettes. It is to be understood that filters according to the present invention can also be used with longer cigarettes. If a longer cigarette is provided, the filter parameters would have to be adjusted, in accordance with the knowledge of those skilled in the art.

EXAMPLE I

A filter according to the most preferred embodiment is discussed above in connection with FIGS. 1 and 2, except that the tow in the peripheral layer was an 8.0/25000 cellulose acetate tow having a denier per fiber of 8.0 and a total denier of 25000, was prepared and mated to an "ultra-light" king-size tobacco rod to produce a cigarette having the following characteristics:

Tobacco 487 mg

Total RTD 107 mm W.G.

Filter RTD 146 mm W.G.

Ventilation 67%

Tipping length 32.0 mm

The cigarette was smoked in a smoking machine under FTC conditions with the following results:

TPM 1.8 mg

Nicotine 0.16 mg

Water 0.21 mg

"Tar" 1.5 mg

Puff Count 6.2

The cigarette, which generates 1.5 mg of "tar", was also smoked by expert smokers, who reported that the cigarette had the taste of a cigarette that generates 4–5 mg of "tar". At 67% ventilation, the filter has an efficiency of about 76%. If there had been no ventilation, the efficiency would have been about 61%.

The cigarette also exhibited a pattern of visible deposition of flitrate on the end of the filter much more like a tow filter as opposed to a web filter, even though most of the flitrate was deposited on the web core. This is believed to be the result of the smoke being forced into core 21 as the ventilation air is introduced at holes 15, and then trying to spread back into peripheral tow layer 20 through permeable wrapper 23.

EXAMPLE II

A filter according to the preferred form of the embodiment of FIG. 5 was prepared and mated to an "ultra-light" king-size tobacco rod to produce a cigarette having the following characteristics:

Tobacco 429 mg

Total RTD 93 mm W.G.

Filter RTD 159 mm W.G.

Ventilation 71%

Tipping length 32 mm

The cigarette was smoked in a smoking machine under FTC conditions with the following results:

TPM 1.6 mg

Nicotine 0.13 mg

Water 0.10 mg

"Tar" 1.4 mg

Puff Count 5.3

As in the case of Example I, this cigarette was smoked by expert smokers who reported that the cigarette had the taste of a cigarette that generates 4–5 mg of "tar".

EXAMPLE III

A filter according to the preferred form of the embodiment of FIG. 5 was prepared and mated to an "ultra-light" king-size tobacco rod to produce a cigarette having the following characteristics:

Tobacco 485 mg

Total RTD 101 mm W.G.

Filter RTD 172 mm W.G.

Ventilation 66%

Tipping length 32 mm

The cigarette was smoked in a smoking machine under FTC conditions with the following results:

TPM 1.4 mg

Nicotine 0.12 mg

Water 0.107 mg

"Tar" 1.1 mg

Puff Count 6.1

As in the case of Examples I and II, this cigarette was smoked by expert smokers who reported that the cigarette had the taste of a cigarette that generates 4–5 mg of "tar".

EXAMPLE IV

A filter according to the preferred form of the embodiment of FIG. 5 was prepared and mated to an "ultra-light" tobacco rod of a length used for 100 mm cigarettes, to produce a cigarette having the following characteristics:

Tobacco 602 mg

Total RTD 106 mm W.G.

Filter RTD 140 mm W.G.

Ventilation 60%

Tipping length 32 mm

The cigarette was smoked in a smoking machine under FTC conditions with the following results:

TPM 2.9 mg

Nicotine 0.22 mg

Water 0.20 mg

"Tar" 2.5 mg

Puff Count 7.5

As in the case of Examples I–III, this cigarette was smoked by expert smokers who reported that the cigarette had the taste of a cigarette that generates 4–5 mg of "tar".

EXAMPLE V

A filter according to the preferred form of the embodiment of FIG. 5 is prepared and mated to an "ultra-light" king-size tobacco rod to produce a cigarette having the following characteristics:

Tobacco 472 mg

Total RTD 106 mm W.G.

Filter RTD 142 mm W.G.

Ventilation 55%

Tipping length 32 mm

The cigarette was smoked in a smoking machine under FTC conditions with the following results:

TPM 3.5 mg

Nicotine 0.21 mg

Water 0.26 mg

"Tar" 3.0 mg

Puff Count 6.1

This cigarette is smoked by expert smokers who report that the cigarette has the taste of a cigarette that generates 6–7 mg of "tar".

EXAMPLE VI

A filter according to the preferred form of the embodiment of FIG. 5 is prepared and mated to an "ultra-light" tobacco rod of a length used for 100 mm cigarettes, to produce a cigarette having the following characteristics:

Tobacco 604 mg

Total RTD 106 mm W.G.

Filter RTD 127 mm W.G.

Ventilation 50%

Tipping length 32 mm

The cigarette was smoked in a smoking machine under FTC conditions with the following results:

TPM 4.9 mg

Nicotine 0.33 mg

Water 0.36 mg

"Tar" 4.2 mg

Puff Count 7.3

As in the case of Example V, this cigarette is smoked by expert smokers who report that the cigarette has the taste of a cigarette that generates 6–7 mg of "tar".

EXAMPLE VII

A filter according to the preferred form of the embodiment of FIG. 5, but using as the concentric filter segment the fifth preferred embodiment of this invention including 10 mg of carbon, was prepared and mated to an "ultra-light" king-size tobacco rod to produce a cigarette having the following characteristics:

Tobacco 490 mg

Total RTD 102 mm W.G.

Filter RTD 161 mm W.G.

Ventilation 68%

Tipping length 32 mm

The cigarette was smoked in a smoking machine under FTC conditions with the following results:

TPM 1.64 mg

Nicotine 0.12 mg

Water 0.12 mg

"Tar" 1.4 mg

Puff Count 6.0

The filter of this invention will improve the taste of low delivery cigarettes. It is also possible that the filter of this invention may offer similar performance at higher deliveries. For example, a medium delivery cigarette may be perceived as a full-flavor cigarette.

Thus, it is seen that a high efficiency filter which produces low delivery while also delivering acceptable taste and other aesthetic impacts is provided. One skilled in the art will appreciate that the present invention can be practiced by other than the described embodiments, which are presented for purposes of illustration and not of limitation, and the present invention is limited only by the claims which follow.

What is claimed is:

1. A smoking filter comprising:

a first filter plug having:

a central core of a web-like material, and a peripheral layer of a fibrous tow filter material surrounding said central core; wherein:

each of said central core and said peripheral layer has a resistance-to-draw, said central core having a resistance-to-draw of between about 200 mm W.G. and about 500 mm W.G. and said filter having a resistance-to-draw of between about 100 mm W.G. and about 230 mm W.G., said peripheral layer having a lower resistance-to-draw than said central core, to initially direct, when said filter is attached to a smoking article and said smoking article is smoked, a greater fraction of smoke through said peripheral layer than through said central core; said first filter plug further having: carbon distributed throughout said central core, said carbon having:

a moisture content between about 3% and about 20.5% of dry weight of the carbon, and butane activity between about 19% and about 27%;

means for admitting ventilation air through said peripheral layer toward said central core, whereby smoke initially directed through said peripheral layer flows into said central core; whereby:

when said filter is attached to a smoking article and said smoking article is smoked, said filtered smoking article delivers smoke containing a particular level of total particulate matter, and the taste of said smoking article is a taste associated with smoke having a level of total particulate matter higher than said particular level.

2. The smoking filter of claim 1, wherein said fibrous tow is cellulose acetate tow.

3. The smoking filter of claim 2, wherein said cellulose acetate tow has a denier per filament of about 8.0 and a total denier of about 30,000.

4. The smoking filter of claim 2, wherein said cellulose acetate tow has a denier per filament of about 2.0–12.0 and a total denier of about 20,000–60,000.

5. The smoking filter of claim 1, wherein said web material is paper.

6. The smoking filter of claim 5, wherein said paper is creped and then corrugated and gathered into said filter.

7. The smoking filter of claim 1, wherein said web material is nonwoven web.

8. The smoking filter of claim 7, wherein said nonwoven web is cellulose acetate sheet.

9. The smoking filter of claim 1, wherein said web material is wrapped in a plug wrap.

10. The smoking filter of claim 9, wherein said plug wrap is porous.

11. The smoking filter of claim 9, wherein said plug wrap is nonporous.

12. The smoking filter of claim 9, wherein said plug wrap contains flavor components.

13. The smoking filter of claim 12, wherein said plug wrap comprises a tobacco-containing material.

14. The smoking filter of claim 13, wherein said tobacco-containing material comprises reconstituted tobacco sheet.

15. The smoking filter of claim 12, wherein said plug wrap comprises plug wrap paper to which flavor components have been added.

16. The smoking filter of claim 15, wherein said flavor components comprise soluble tobacco components.

17. The smoking filter of claim 1, having a ventilation rate of about 40–75%.

18. The smoking filter of claim 17, having a filtration efficiency of about 60–90%.

19. The smoking filter of claim 1, wherein said core has a cross-sectional area occupying about 20–80% of the total cross-sectional area of said filter.

20. The smoking filter of claim 1, wherein said filter has a resistance-to-draw of about 100–150 mm W.G., said central core having a resistance-to-draw of about 200–400 mm W.G.

21. The smoking filter of claim 1, further comprising a second filter plug of cellose acetate tow adjacent said first filter plug.

22. The smoking filter of claim 21, wherein said first filter plug has a resistance-to-draw of between about 85 mm W.G. and about 175 mm W.G., said central core having a resistance-to-draw of between about 195 mm W.G. and about 450 mm W.G., and said second filter plug has a resistance-to-draw of between about 10 mm W.G. and about 45 mm W.G., such that said filter has a resistance-to- draw of between about 100 mm W.G. and about 180 mm W.G.

23. The smoking filter of claim 22, wherein said first filter plug has a resistance-to-draw of about 146 mm W.G., said inner core having a resistance-to-draw of about 357 mm W.G., and said second filter plug has a resistance-to-draw of about 14 mm W.G., such that said filter has a resistance-to-draw of about 160 mm W.G.

24. The smoking filter according to claim 23, wherein said carbon comprises about 60 mg. of carbon particles.

25. The smoking filter according to claim 22, wherein said central core has resistance-to-draw between about 268 mm W.G. and about 446 mm W.G. and said second filter plug has a resistance-to-draw of about 13 mm W.G.

26. The smoking filter according to claim 21, wherein said second filter plug of cellulose acetate tow has a denier per filament of about 8.0 and a total denier of about 40,000.

27. The smoking filter of claim 1, further comprising tipping wrapped therearound, said tipping extending beyond a first end of said first filter plug for attaching said filter to a cigarette and extending beyond a second end of said first filter plug opposite said first end, forming a mouth-end recess in said filter.

28. The smoking filter of claim 1, wherein said core and said peripheral layer are concentric.

29. The smoking filter of claim 1, comprising between about 5 mg and about 35 mg of said carbon particles.

30. The smoking filter of claim 29, comprising about 10 mg of said carbon particles.

31. The smoking filter of claim 1, wherein said carbon particles have a moisture content of about 18% of the dry weight of said carbon particles.

32. The smoking filter of claim 1, wherein said carbon particles have a moisture content between about 15.5% and 20.5%.

33. The smoking filter of claim 1, wherein said carbon particles are substantially uniformly distributed throughout said central core.

34. The smoking filter of claim 1, wherein said carbon particles are held in place by an adhesive material.

35. The smoking filter of claim 1, comprising between about 10 mg to about 60 mg of carbon.

36. The smoking filter of claim 1, comprising between about 0.5 mg and about 3.0 mg of carbon per mm and length of said filter.

37. The smoking filter of claim 1, wherein said fibrous tow is a polyolefin.

38. The smoking filter of claim 1, wherein said fibrous tow is polypropylene.

39. The smoking filter of claim 1, wherein said fibrous tow is polyethylene.

40. The smoking filter of claim 1, wherein said carbon is impregnated in said web-like filter material.

41. The smoking filter according to claim 1, wherein said web-like material is paper and said carbon is added to said paper during manufacture.

42. The smoking filter of claim 1, wherein said filter has a resistance-to-draw of about 135 mm W.G., said central core having a resistance-to-draw of about 370 mm W.G.

43. The smoking filter according to claim 1, wherein: said fibrous tow is cellulose acetate tow, wherein said cellulose acetate tow has a denier per filament of about 8.0 and a total denier of about 30,000;

wherein said web material is paper; wherein said said carbon comprises about 60 mg of carbon particles, wherein said carbon particles have a moisture content of about 18% of the dry weight of said carbon particles, wherein said filter has a resistance-to-draw of about 100–150 mm W.G., said central core having a resistance-to-draw of about 200–400 mm W.G.

44. The smoking filter according to claim 43, further comprising a second filter plug of cellose acetate tow adjacent said first filter plug, wherein said first filter plug has a resistance-to-draw of about 146 mm W.G., said inner core having a resistance-to-draw of about 357 mm W.G., and said second filter plug has a resistance-to-draw of about 14 mm W.G., such that said filter has a resistance-to-draw of about 160 mm W.G.

45. The smoking filter according to claim 1, wherein said carbon particles have a size distribution such that approximately 95% of said particles are between about 12 mesh and about 70 mesh.

46. The smoking filter according to claim 45, wherein approximately 95% of said particles are between about 12 mesh and about 30 mesh.

47. The smoking filter according to claim 45, wherein approximately 95% of said particles are between about 20 mesh and about 70 mesh.

48. The smoking filter according to claim 44, wherein said carbon is coconut base.

49. The smoking filter according to claim 45, wherein approximately 95% of said particles are between about 14 mesh and about 40 mesh.

50. The smoking filter according to claim 1, wherein said peripheral layer of fibrous tow material has a cross-section selected from the group consisiting of Y, R, X, O and I shapes.

51. The smoking filter according to claim 49, wherein said carbon is coconut base.

52. The smoking filter according to claim 1, wherein said central core has a resistance-to-draw between about 268 mm W.G. and about 446 mm W.G.

53. The smoking filter according to claim 1, wherein said central core has a resistance-to-draw of about 357 mm W.G.

54. The smoking filter according to claim 52, wherein said carbon is coal base.

55. The smoking filter according to claim 1, wherein said central core of web-like material is creped with approximately 3–20% cross-wise creping.

56. The smoking filter according to claim 1, wherein said carbon comprises carbon dust.

* * * * *